United States Patent [19]

Mays

[11] Patent Number: 4,555,430

[45] Date of Patent: Nov. 26, 1985

[54] ENTANGLED NONWOVEN FABRIC MADE OF TWO FIBERS HAVING DIFFERENT LENGTHS IN WHICH THE SHORTER FIBER IS A CONJUGATE FIBER IN WHICH AN EXPOSED COMPONENT THEREOF HAS A LOWER MELTING TEMPERATURE THAN THE LONGER FIBER AND METHOD OF MAKING SAME

[75] Inventor: Alfred T. Mays, East Windsor, N.J.

[73] Assignee: Chicopee, New Brunswick, N.J.

[21] Appl. No.: 641,144

[22] Filed: Aug. 16, 1984

[51] Int. Cl.[4] ..... B32B 3/10

[52] U.S. Cl. ..... 428/134; 28/103; 28/104; 28/112; 428/131; 428/171; 428/212; 428/224; 428/288; 428/296; 428/297; 428/299; 428/373

[58] Field of Search ..... 28/103, 104, 112; 428/131, 134, 171, 224, 288, 296, 297, 299, 373, 212

[56] References Cited

U.S. PATENT DOCUMENTS

| | | | |
|---|---|---|---|
| 3,033,721 | 5/1962 | Kalwaites | 428/296 |
| 3,485,706 | 12/1969 | Evans | 428/171 |
| 3,498,874 | 3/1970 | Evans et al. | 428/134 |
| 4,039,711 | 8/1977 | Newman | 428/296 |
| 4,131,704 | 12/1978 | Freckson et al. | 428/296 |
| 4,259,399 | 3/1981 | Hill | 428/373 |
| 4,320,167 | 3/1982 | Wishman | 428/296 |
| 4,373,000 | 2/1983 | Knobe et al. | 428/198 |

*Primary Examiner*—James J. Bell

*Attorney, Agent, or Firm*—Nancy A. Bird

[57] ABSTRACT

There is disclosed a fabric made up of short conjugate fusible fibers and longer, base fibers. The conjugate fibers have an exposed low melting point component having a lower melting point than the remainder of said fibers and said base fibers. In the method of the present invention, a web of short conjugate fibers and longer base fibers is passed through an entangling mechanism where the short fusible fibers are concentrated and intertwined in heavily entangled knot areas. The entangled web is heated to thermobond at least the low melting point component of the conjugate fibers to each other and preferably to the surrounding base fibers to reinforce and strengthen the fabric.

14 Claims, 3 Drawing Figures

ENTANGLED NONWOVEN FABRIC MADE OF TWO FIBERS HAVING DIFFERENT LENGTHS IN WHICH THE SHORTER FIBER IS A CONJUGATE FIBER IN WHICH AN EXPOSED COMPONENT THEREOF HAS A LOWER MELTING TEMPERATURE THAN THE LONGER FIBER AND METHOD OF MAKING SAME

BACKGROUND OF THE INVENTION

In nonwoven fabrics made of entangled fibers having entangled areas and interconnecting fiber bundles used in various products, such as facings, towels, liners, wipes, and similar applications, there is an inherent weakness in the entangled or "knit" areas where a substantial portion of the fibers is displaced during the entangling action, thus reducing the strength of the fabric. This weakness reduces the reusability and washability of the fabric. It would, therefore, be desirable to form a nonwoven fabric during which provision is made to reinforce these areas, which would serve to provide greater strength and thus durability making wider application of the fabric possible.

It has been known in the art to employ very short, rigid, fusible rods in the entangled or knot areas of an entangled fabric to reinforce the fabric. Short, relatively thick rods of nylon, or the like, have been located in the bud portions, which rods are bonded to the surrounding fibers to strengthen th same. These very short, relatively thick rods (approximately 1/32 inch long, or shorter, of 15 denier material) retain their rod configuration during processing and are not entangled with significant quantities of the surrounding fibers in the bud portin, which minimizes the strength they add to the fabric in the bud area. Additionally, the bulk of the rod adds a hardness to the fabric not present when a relatively short, fusible, bondable fiber capable of being bent is entangled and thus mechanically locked to surrounding fibers in the bud area to strengthen the same.

A patent disclosing a nonwoven fabric employing such short, thick rods in the knot areas and a machine for making same is disclosed in U.S. Pat. No. 3,033,721 granted to F. Kalwaites and assigned to the assignee of the present invention. The patent also claims a nonwoven fabric having fused thermoplastic fibers in the bud areas.

In the present invention, it has been recognized that additional fabric strength in the knot or entangled areas can be obtained if the shorter fibers retained their fiber integrity, and it is to this end that this application is directed. Maintaining the integrity of these fibers maintains the high loft or low bulk characteristics of the finished nonwoven fabric in order to achieve optimum absorption capacity and strength.

Additionally, reference is also made to an application Ser. No. 641,239 filed Aug. 16, 1984, filed concurrently herewith, entitled "An Entangled Nonwoven Fabric Including Conjugate Fibers and the Method of Making Same," in which conjugate fibers are employed and the strength improved by the use of conjugate fibers is obtained. However, the fibers employed in the fabric disclosed in the last-mentioned application are essentially the same length and the conjugate fibers are not concentrated in the knot area to specifically reinforce that portion of the fabric.

BRIEF SUMMARY OF THE INVENTION

In accordance with the present invention, it is desired to provide an entangled fiber fabric having significant improvement in tensile strength over similarly entangled fabrics and rearranged fabrics employing reinforcing homofil fibers in the bud areas. This is accomplished by making the fabric of two intermixed groups of fibers of different lengths comprising a group of base fibers, which in the preferred embodiment will constitute a major portion of the fabric, and a second group of conjugate thermoplastic fusible fibers which are shorter than the first group of base fibers. The base fibers can be a variety of natural and synthetic fibers, including nylon, polyester, rayon, cotton, etc., so long as they are capable of being formed into an entangled fabric.

The conjugate fibers have different polymer components disposed across the cross-section of the fiber, and specifically have a low melting point component and at least one high melting point component. The low melting point component has a softening or thermobonding temperature lower than that of the softening or thermobonding temperature of the high melting point component, and the base fibers. The shorter fusible fibers should be long enough not to wash out during the entanglement step, but shorter than the base fibers to preferentially move the shorter fibers into the entangled or knot area during the entanglement process and fine enough to bend, so that they may be entangled with other fibers in the entangled or knot area.

In a preferred embodiment, the shorter of the two fibers is a polyester/polyethylene conjugate fiber. It is preferred to employ sheath/core fibers with polyethylene as the sheath and polyester as the core. Either eccentric or concentric sheath/core fibers can be employed. Bicomponent fibers disposed in side-by-side relationship can also be used if desired.

Preferably, the conjugate fibers employ high density polyethylene, that is, linear polyethylene that has a density of at least about 0.94, and a Melt Index ("M.I.") by ASTM D-1238(E) (190° C., 2160 gms.) of greater than 1, preferably greater than about 10, and more preferably from about 20 to about 50. Usually the fibers will be composed of about 40 to 60 weight percent, and preferably 45 to 55 weight percent, polyester, the remainder being polyethylene.

Other conjugate fibers having utility in the present invention are heterofil medium tenacity fibers. Such fibers, which are available from ICI Fibers, Harrogate, North Yorkshire, England, under product codes 3.3/100/V303, 3.3/50/V303, 6.7/50/V302, 13/65/V302, and 13/100/V302 include sheath/core fibers wherein the sheath is a nylon 6 material and the core is a higher melting point nylon 66 material. Such fibers are particularly useful in combination with polyester base fibers. Other medium tenacity heterofil fibers available from ICI Fibers for use in the present invention will include polyester fibers sold under product codes 3.3/50/V544 and·3.3/90/V544. Other suitable sheath/core fibers include fibers having polyethylene or polyethylene terephthalate as a core material and an isophthalic copolymer as the sheath material.

Other examples of polymer pairs suitable for use in the conjugate fibers of the fabrics of the present invention are copolyester/polyester, nylon/polyester, and nylon 6/polypropylene.

During the entangling action, the shorter length thermoplastic conjugate fibers are "pulled" into and concentrate in the knots or regions of greatest entanglement. Increased tensile strength will be obtained, since when the web is subsequently subjected to heat treatment at a temperature to soften and thermobond only the low melting point component of the conjugate fibers, the conjugate fibers will be thermobonded to each other, and preferably to the longer base fibers to strengthen the fabric especially in the heavily entangled fiber region or "knot" area, the weakest points in the fabric structure, while leaving the soft connecting fiber bundles unchanged.

In one embodiment, short polyolefin fibers having a melting temperature of in the range of 163°–171° C. can be use. The term "polyolefin fibers," as used herein and in the appended claims, refers to manufactured fibers in which the fiber-forming substance is any long chain synthetic polymer comprised of at least 85 percent by weight of ethylene, propylene, or other olefin units, except amorphous (non-crystalline) polyolefins qualifying as rubber. It is, of course, within the scope of this invention to use other thermoplastic fibers as the shorter of the two groups of fibers employed, so long as they have a melting teperature significantly less than the group of longer fibers. An example of such thermoplastic fibers is low melt polyester fibers. The shorter fibers employed in this invention are on the order of ⅛ to ½ inch, with 3/16 to ⅜ inch being the preferred length.

The longer base fibers are of staple length and in excess of ½ inch in length. Typical base fibers that can be used are polyester and Nylon 6, which have melting temperatures in the range of about 250°–288° C. and about 213°–221° C., respectively, which melting temperatures are significantly greater than the polyolefin fibers referred to above. The shorter thermoplastic fibers used in accordance with this invention should be generally the same denier as the longer fibers which constitutes the base web material. The denier of the fibers should be such as to allow bending of the fibers and should be on the order of ½ to 5 denier, with the preferred range being from about ½ to 3½ denier.

The fabrics formed in accordance with the present invention will typically include about 3 percent to 20 percent by weight of the end product. The preferred amount of such fibers is in the range of 5 percent to 10 percent by weight of the end product.

During the entangling process, the shorter length fibers may be intermingled in random fashion and become interlocked into a three-dimensional bud or knot structure as shown in U.S. Pat. No. 3,033,721. In the bud structure, the fibers are mechanically engaged, both frictionally and through interlocking of the fibers. The fibers may also be entangled by the method set forth in U.S. Pat. No. 3,485,706 to form entangled areas with interconnecting fiber bundles.

Briefly, as set forth in detail in Evans U.S. Pat. No. 3,485,06, it has been known to produce a wide variety of textile-like nonwoven fabrics by entangling the adjacent fibers. This is accomplished by traversing the fibrous material with high-energy liquid streams while supported on an apertured member, such as a perforated plate or woven wire screen, to consolidate the material in a repeating pattern of entangled fiber regions and interconnecting fiber bundles. The fibers are randomly entangled in a manner which holds the fibers of the fabric in place without the need for bonding agents. An example of a process used for producing an entangled fiber fabric includes the treating of a loose layer of fibers with liquid jetted at a pressure of at least 200 psi from a row of small orifices to convert the layer into coherent, highly stable, strong nonwoven fabrics which resemble many textile fabrics prepared by conventional processes, such as mechanical spinning, or weaving.

The products produced in this fashion result in fibers locked into place by fiber interaction to provide a strong cohesive structure without the need for binder or filament fusing. The products have a repeating pattern of entangled fiber regions, of higher area density (weight per unit area) than the average area density of the fabric, and include interconnecting fiber bundles which extend between the entangled regions. The fibers of the interconnecting fiber bundles extending between adjacent entangled regions are entangled with the fibers in the entangled or knot areas.

It is desired, of course, to improve the strength of the fabric at the "knots," or entangled areas, and one way of accomplishing this would be to reinforce the knot or entangled area by providing additional reinforcing fibers at these areas. To provide this added strength, a group of thermoplastic fibers shorter than the base fibers are combined with the base fibers during the formation of the fibrous web by carding, air laying, or the like. It is preferred to employ a card or a dual rotor such as is shown by Ruffo et al. in U.S. Pat. No. 3,768,118 as the web forming device, although other web forming apparatus can be employed, if desired.

The fibrous web is then passed through an entangling device and during the entangling process the shorter fibers are concentrated to a greater extent in the entangled fiber or knot areas. The short fibers wrap around the longer base fibers and are highly entangled to bind the longer fibers securely into the body of the fabric. This increases the durability of the fabric. However, while this adds to the strength of the fabric, it does not adversely effect the softness of the resulting fabric. It has been further found that by thermal bonding the shorter fibers to adjacent fibers, the fabric strength can be increased and a stronger nonwoven fabric can be produced which does not require the addition of an adhesive, or the high energy input for intense entangling.

Thus, in accordance with the present invention, the fabric is made up of groups of fibers of two different lengths in which the shorter conjugate fibers have a low melting point component having a melting or softening range lower than that of the longer fibers. Thus, when the fabric is heated, the low melting point component of the conjugate fibers will thermobond to the surrounding fibers which greatly increases the strength of the fabric, especially in the entangled areas, and thus the total fabric. With this increased strength, it can readily withstand repeated uses and thus be suitable for those products currently employing nonwoven fabrics, as well as others which have required fabric strength which have heretofore not been available.

However, since the high melting point component of the conjugate fibers does not melt, the conjugate fibers retain their fiber integrity and the mechanical bond obtained by their entanglement with adjacent fibers is retained and the strength of the heavily entangled areas is greater than when a single strand fusible fiber is employed in the knot area, since such fibers tend to form globules and lose their fiber integrity and the attendant reinforcing strength that goes along with fiber integrity. With this increased strength, it can readily withstand repeated uses and washings and thus be suitable for those products currently employing nonwoven fabrics, as well as others which have required fabric strengths which have heretofore not been available.

The fabric referred to above is a fabric formed solely by entangling and thermobonding of the conjugate fibers and does not employ any separate binder of the type commonly employed to adhere fibers together to make a fabric. The present invention could, of course, be employed with a modified entangled fiber type of faric which is one in which the entanglement takes place under relatively low pressure, and to which binder quantities on the order of 1½ percent are introduced, which binder can be any of the conventional binders used to bond fabrics of this type.

DESCRIPTION OF THE PREFERRED EMBODIMENTS

Figure 1:
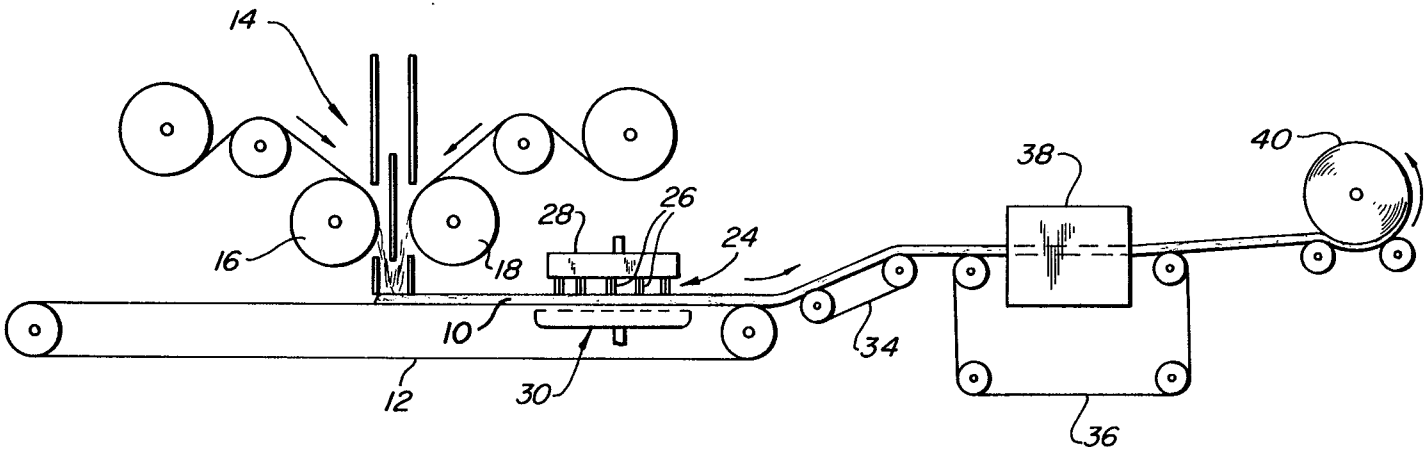
FIG. 1 is a schematic side elevation of an apparatus for carrying out the method of the invention.

Referring now to FIG. 1, there is shown one arrangement of an apparatus that can be used to produce the fabrics of the invention. A web 10 made up of two different lengths of fibers is laid on an endless aperatured belt 12 for further processing. In the embodiment illustrated, this web 10 is produced by a dual rotor apparatus 14 into which are fed fibers of different lengths by cards 16, 18. The card 16 is used to provide the shorter length fusible fiber, such as polypropylene, and the card 18 is used to provide the longer length base fibers, such as polyester. The web made up of the two different length fibers consisting of short fibers 20 and base fibers 22 is conveyed to an entangling device 24 of the type disclosed in Evans U.S. Pat. No. 3,485,706.

In the entangling device, the belt 12 carries the web of fibers 10 under a series of high pressure, fine, essentially columnar jets of water 26. The high pressure water is supplied from a manifold 28. The jets 26 are arranged in rows disposed transversely across the path of travel of the belt 12. Preferably, there is a vacuum means 20 pulling a vacuum of, e.g., up to 5 to 10 inches of mercury, beneath the belt 12, with a vacuum slot positioned directly under each row of jets 26. The fibers in the web 10 are rearranged and entangled by the jets 26 as the liquid from the jets 26 passes through the fibrous web 10 and then through the belt 12.

Apparatus of the generally type disclosed by Evans can be used in the process of this invention, although typically the degree of entanglement contemplated by this invention is much less than that generally preferred by Evans.

The method of fiber rearranging shown in U.S. Pat. No. 3,033,721, incorporated herein by reference may also be used to rearrange the fibers into a three dimensional fabric having knot areas corresponding to the entangled areas formed by the Evans process.

Figure 2:
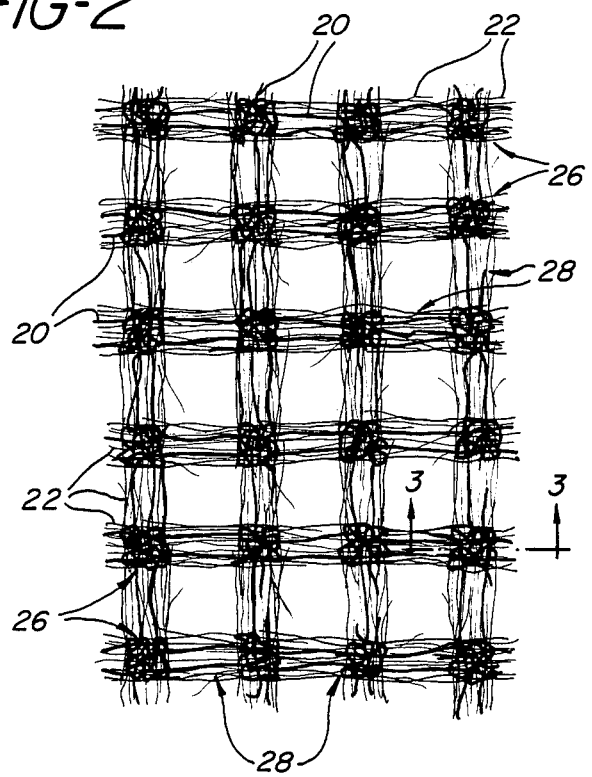
FIG. 2 is an enlarged illustration of an entangled fabric incorporating the two groups of shorter and longer fibers.

In the entangling device, the web is formed, as shown in FIG. 2, into groups of entangled areas 26 which are connected to adjacent entangled areas 26 by interconnecting fiber bundles 28 of predominantly base fibers 22 to form the web pattern as determined by the jets and belt configuration in the entangling process. During this process, the shorter length fibers 20 are concentrated and mechanically entwined in the entangled areas with each other and base fibers 22.

The endless belt 12 transfers the entangled web via a conveying mechanism including belts 34, 36 to an oven 38, where it is subjected to elevated temperatures to thermobond the shorter polypropylene fibers to each other and to longer base fibers, forming adhesion bonds and inclusion bonds (wherein the polyethylene melts and flows around the adjacent fiber) at the points of fiber-to-fiber contact. In this embodiment, the web is thermal bonded under conditions of zero pressure, or very light pressure so that the web is not significantly crushed or compacted during the thermal bonding step. The exact temperatures employed in the thermal bonding will vary depending upon the weight ard bulk density of the web, and upon the dwell time employed in the heated zone. For instance, bonding temperatures within the range from about 130° C. to about 180° C. have been found satisfactory for the various types of thermoplastic short fibers that can be used in accordance with the present invention. Dwell times in the bonding zone will generally vary from about 2 seconds to one minute, and more normally will be from 3 to about 4 seconds. The important factor in selecting the heating conditions for optimum bonding is to heat the short fibers to their melt point, but not to melt the longer base fibers forming the base material for the web.

Upon cooling, shorter fibers solidify and excellent fiber-to-fiber contact is thereby fored. Simple exposure to ambient air will provide adequate cooling.

The thermal bonding step can be carried out by through-air bonding as illustrated in FIG. 1 by the oven 38, or by other means such as infrared heating, or other types of heating. If desired, the thermal bonding step can be performed by passing the web between heated embossing or calendering rolls. With the latter method, some compaction and densification of the web takes place. In the method and fabric of the present invention, thermobonding must be effected without destroying the fibrous nature of the fusible fibers. After thermal bonding and cooling to solidify the bonds, the fabric of the invention is collected as on a conventional windup roll 40.

Figure 3:
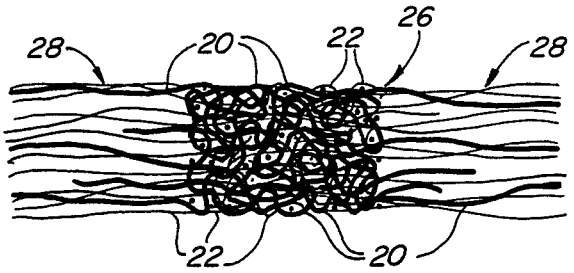
FIG. 3 is a view taken along line 3—3 of FIG. 2.

The construction of the fabric in the entangled areas can best be appreciated by references to FIG. 3. As can be seen therein, the longer base fibers 22 predominate in the connecting fiber bundles 28 and are entangled with the shorter thermoplastic fibers 20 in the knot zones 26. When the entangled fibers 20, 22 are passed through the oven 38, the short thermoplastic fibers 20 form thermal bonds at the intersections of the fibers 20 with each other and with the longer base fibers 22.

It is intended to cover by the appended claims all such methods and fabrics that are covered thereby.

What is claimed is:

1. A strong durable nonwoven fabric comprising base fibers and conjugate fusible fibers of shorter length than said base fibers, and having a low melting point component and at least one high melting point, said fibers being arranged in a network of entangled fiber areas of higher density than the average density of the fabric, and interconnecting fiber bundles, the fibers of said interconnecting fiber bundles extending between and are entangled within the entangled fiber areas, said shorter length conjugate fibers being concentrated in said entangled fiber areas, and thermobonded to each other at fiber intersections to reinforce and strengthen the fabric, especially in said entangled fiber areas.

2. A nonwoven fabric as in claim 1 wherein said conjugate fibers are thermobonded to the base fibers of the fabric.

3. A fabric as set forth in claim 2 in which the conjugate fiber is a bicomponent sheath/core conjugate fiber, and the low melting point component forms the sheath of the fiber.

4. A fabric as set forth in claim 2 in which the conjugate fibers is a bicomponent fiber and the low melting point component and the melting point components are disposed in side-by-side relationship.

5. A fabric as set forth in claims 3 or 4 in which the low melting point component is polyethylene.

6. A fabric as set forth in claim 3 or 4 in which the high melting point component is polyester.

7. A fabric as set forth in claim 1 in which the length of the shorter length fibers are from $\frac{1}{8}$ to $\frac{1}{2}$ inch.

8. A fabric as set forth in claim 1 in which the length of the shorter length fibers are from 3/16 to $\frac{3}{8}$ inch.

9. A fabric as set forth in claims 2 or 3 in which the denier of the fibers is $\frac{1}{2}$ to 5.

10. A fabric as set forth in claims 1, 2, or 3 in which the conjugate fibers are in an amount of about 3% to 20% by weight of the end product.

11. A method of forming a nonwoven fabric comprising the steps of: providing a fibrous web comprising base fibers and conjugate fusible fibers of shorter length than said base fibers and having an exposed low melting point component and at least one high melting point component, passing essentially columnar jets of fluid under pressure through said web to displace fibers of the web into a network of entangled fiber areas of higher density than the average density of the web and interconnecting fiber bundles extending between the entangled fiber areas, wherein the conjugate fibers are concentrated and mechanically intertwined in said entangled fiber areas; and thereafter thermobonding said conjugate fibers to each other to produce a bonded entangled fabric.

12. A method as set forth in claim 11 in which the conjugate fibers are thermobonded to said base fibers.

13. A method as in claim 12 wherein in which said conjugate fiber is a bicomponent sheath/core conjugate fiber, and the low melting point component forms the sheath.

14. A method as set forth in claim 12 in which the conjugate fiber is a bicomponent fiber and the low melting point component and the high melting point components are disposed in side-by-side relationship.

* * * * *